US005241350A

United States Patent [19]

Bigelow

[11] Patent Number: 5,241,350

[45] Date of Patent: Aug. 31, 1993

[54] BLADE HOLDER WITH END CLAMPS

[75] Inventor: Richard W. Bigelow, Webster, N.Y.

[73] Assignee: Xerox Corporation, Stamford, Conn.

[21] Appl. No.: 937,565

[22] Filed: Aug. 31, 1992

[51] Int. Cl.[5] ..... G03G 21/00

[52] U.S. Cl. ..... 355/299; 15/256.5

[58] Field of Search ..... 355/299; 15/256.5, 256.51, 15/256.53

[56] References Cited

U.S. PATENT DOCUMENTS

| | | | |
|---|---|---|---|
| 3,847,480 | 11/1974 | Fisher | 355/299 X |
| 4,083,633 | 4/1978 | Shanly | 355/299 |
| 4,151,797 | 5/1979 | Dunsirn | 15/256.51 X |
| 4,640,608 | 2/1987 | Higaya et al. | 355/299 |
| 4,802,928 | 2/1989 | Dunlap | 15/256.51 X |
| 4,989,047 | 1/1991 | Jugle et al. | 355/297 |

FOREIGN PATENT DOCUMENTS

| | | | |
|---|---|---|---|
| 62-3274 | 1/1987 | Japan | 355/299 |

*Primary Examiner*—Joan H. Pendergrass
*Attorney, Agent, or Firm*—T. L. Fair

[57] ABSTRACT

A cleaning blade holder apparatus that has at least one end clamping mechanism on one side of the cleaning blade holder body. The end clamping mechanism is connected to the blade holder body by an adjustable spacer (e.g. springs) and set screws. The adjustable spacer spring loads the end clamp against the holder body so that when the screws are withdrawn the coupled blade holder body and end clamp expand to stretch the blade laterally. This places the blade in tension and creates uniform contact between the imaging surface and the cleaning blade.

8 Claims, 5 Drawing Sheets

BLADE HOLDER WITH END CLAMPS

BACKGROUND OF THE INVENTION

This invention relates generally to an electrostatographic printer and copier, and more particularly concerns a cleaning apparatus.

Blade cleaning of photoreceptors (i.e. imaging surfaces or photoconductors) is basically a simple and economical concept that has reliability concerns when used in middle and high volume copier or printer machine applications due to apparent random failures. Such random failures justify the reluctance to include blade cleaners in higher volume machines without, or even with, some back-up cleaning element. Alternative cleaning devices, including magnetic, insulative and electrostatic brush assemblies are invariably installed as the primary cleaning element in higher volume machine applications. Use of devices exhibiting predictive or deterministic failure modes also facilitate identification and resolution of cleaning problems rising from other sources. Manifestations of deterministic cleaning failures include, but are not limited to, photoreceptor filming and cometing. (Cometing is where material, including toner particles, become impacted onto the photoreceptor and adhere with such force that they cannot be removed by the shearing or scraping action of the cleaning element.) Specific failures can also be, in part, material related (for example, involving the toner and the additives).

In contrast, random cleaning blade failures can arise because of inherent variations or flaws in the elastomer blade material. Such nonuniformities or defects in the blade material can cause or permit repeated stresses and strains occurring in the cleaning member during normal copy operation to locally and prematurely fatigue the contacting blade edge at the point of the flaw. An additional random failure mode for blade cleaners can arise from undesired and objectionable developed image related enhancements or reductions in the blade edge/-photoreceptor friction. Such variations in contact friction can lead to unacceptably large tuck-under of a normal doctor blade edge. (A doctor blade edge is where the cleaning edge of the blade acts in a chiselling motion. This differs from a wiper blade edge, which, as its name implies, operates in a wiping fashion against the photoreceptor surface being cleaned.) A large enough tuck or break in the blade/photoreceptor seal can permit untransferred toner and other residual debris to pass or leak under the blade preventing the intended and essential cleaning action. Inhomogeneities in blade/-photoreceptor contact can not only lead to a decreased cleaning efficiency according to the aforementioned process, but in severe cases can result in catastrophic system failure when, for example, the friction between the blade and photoreceptor becomes so great that the entire blade "flips over" or reverses so as to go from a doctor to a wiper-like position. However, in spite of these problems with the use of a blade cleaner, the copier/printer industry trend is toward applying some form of a photoreceptor blade cleaning system in the higher volume products.

Various strategies have been implemented or proposed to enhance the contact properties between the blade and photoreceptor. These include: agitation of the blade against the photoreceptor to prevent build-up of material along the contact seal; addition of redundant members, such as disturber brushes to loosen or collect debris which might otherwise stress the blade element; addition of lubricants to the toner, photoreceptor and-/or blade; and roughening of the photoreceptor surface to reduce the blade/photoreceptor contact area, and thus, the blade friction.

The first two of these strategies increases the mechanical complexity and the cost of the cleaning assembly. The addition of lubricants, in the third strategy, increases complexity and introduces compatibility issues. And, the fourth strategy can also introduce compatibility problems depending on how surface roughening (i.e. roughening is where micron size asperities are engineered into the photoreceptor surface with the specific intent to reduce the contact friction between the cleaning device and the surface) is introduced (for example, particulate additives to the bulk of the transport layer can degrade electrical and/or mechanical properties). However, any such surface asperities can be worn away in a normal machine copy operation and thus, limit any cleaning benefit (i.e. the reduction in friction between the surface and the cleaning device achieved by the introduction of the asperities can be lost if normal copy operation is sufficiently aggressive to erode the asperities and smooth the photoreceptor surface). Surface roughening can also have direct adverse effects such as the introduction of sites against which toner can become lodged. Photoreceptor surface roughening can also inhibit cleaning by reducing friction in such a way as to allow the cleaning blade edge to pass over toner and other surface debris. This residual material passed over by the blade can later become pressed into the photoreceptor surface by other parts of the cleaning blade so as to serve as nucleation sites for comet growth.

One of the most common "predictable" or non-random blade cleaning failures is cometing on the photoreceptor. This type of failure is generally encountered and resolved during program development. As previously stated, in cometing, material, including toner particles, become impacted onto the photoreceptor and adhere with such force that they cannot be removed by the shearing or scraping action of the cleaning element. Additional debris, including untransferred toner, and developer and/or toner additives and their residue, can be impacted against the asperity. Repeated passes during the copier or printer process can lead to the build-up of elongated crusty deposits in front of the asperity which eventually print out as spots on the copy. These elongated deposits are called comets.

Once again various strategies have also been implemented or proposed to deal with this type of blade cleaning problem, many of which are redundant with those already mentioned. Additional approaches to the resolution of cometing problems include: elimination of the material which impacts, or builds up in the tail; include additives to the toner and/or developer which lubricate the contacting surfaces and/or scavenge the offending material; and development of a photoreceptor surface or surface coating which has an inherent resistance to toner impaction and/or cometing.

The prevailing opinion as to the origin of comets in blade systems is that localized tucks in the cleaning edge allow the toner particles or comet heads to be compressed into the photoreceptor. Thus, it is surmised that cometing and the more random type of blade cleaning failures may be related.

Blade edge tuck characterizes the tendency of the blade edge to curl or roll under in response to the dynamic friction forces established between the moving photoreceptor and loaded blade. It is intuitive that any mechanism or interaction which increases contact friction will increase blade edge tuck. Furthermore, the degree or magnitude of tuck can vary from point to point along the contacting length, consistent with the flexible nature of the blade material. Generally, edge tuck is not uniform when a blade rides against a smooth photoreceptor, but fluctuates locally along the full contact length in response to localized differences in dynamic friction.

It has been demonstrated, for example, that photoreceptor surface asperities of appropriate dimension can induce an elastomer blade edge to ride in a position of reduced and near uniform tuck. Such enhancement in contact uniformity is attributed to a continuous local reseating of the regions of excessive edge curl or tuck induced by the random distribution of asperities at the photoreceptor surface. Reseating is herein defined as the correction of a nonuniformly contacting cleaning blade edge to a position of greater uniform contact. A continuously temporal and spatial local reseating of the blade edge thus prohibits and/or inhibits the build-up of large friction enhancements which can increase the edge tuck to the point where cleaning failure occurs.

It has been hypothesized that photoreceptor surface asperities can produce localized stress/strain relationships at the contacting blade edge which tend to counter the distortion (tuck) forces generated by enhanced blade/photoreceptor friction. Loading of the blade against the photoreceptor causes the asperities to form local microscopic indentations in the blade edge in a direction away from vertical to the photoreceptor surface. Such selective compression of the blade edge counteracts the localized lateral stretching or excessive tucking of the edge. Photoreceptor surface asperities thus introduce local forces into the cleaning problem which tend to pull or draw adjacent excessively tucked blade edge regions back into the desired compliance.

Evidence supporting the aforementioned hypothesis was obtained from extensive print studies using a commercial xerographic copy machine operating with a seamed belt photoreceptor, a stand-along blade cleaner, and toner without special additives to inhibit photoreceptor cometing. A result of some significance was that printable comets first became noticeable on the last photoreceptor panel cleaned after the belt seam, or in a position after the blade was in the longest intimate continuous contact with the photoreceptor surface. Printable comets were never observed in prints produced from the panel immediately after the belt seam—this is the section of the photoreceptor first encountered by the blade after the blade has passed the seam. It is believed that the bump or displacement received by the blade when passing over the belt seam (i.e. this displacement is experimentally observable) dislodges accumulated toner debris from the cleaning blade edge and also allows the blade to reseat and ride in a less tucked position, hence, the absence of comets in the first photoreceptor panel after the seam.

A standard blade holder is disclosed in a U.S. Pat. No. 4,083,633, issued Apr. 11, 1978 to A. L. Shanly. The present invention represents a development in the above-cited technology, and accordingly this reference is incorporated by reference in the present specification.

The following disclosures may be relevant to various aspects of the present invention and may be briefly summarized as follows:

U.S. Pat. No. 4,989,047 to Jugle et al. discloses an apparatus for cleaning an electrophotographic printer imaging surface. The cleaning apparatus includes a primary cleaner device and a secondary cleaning member. The secondary cleaning apparatus consists of a blade holder pivotally connected to the housing that holds a cleaning blade in frictional contact with the imaging surface.

U.S. Pat. No. 4,640,608 to Higaya et al. discloses an apparatus for cleaning a photoconductive surface. The cleaning apparatus includes a blade holder that detachably holds a cleaning blade between two members that are fastened together.

SUMMARY OF THE INVENTION

Briefly stated, and in accordance with one aspect of the present invention, there is provided an apparatus for removing residual particles from an imaging surface. This apparatus includes a cleaning blade having an edge adapted to remove the residual particles from the imaging surface. Means for supporting the cleaning blade, where the supporting means applies a tension force on the cleaning blade in a direction substantially parallel to the edge thereof to provide substantially uniform contact between the edge of the blade and the imaging surface.

Pursuant to another aspect of the present invention, there is provided a blade holding device for placing a cleaning edge of the cleaning blade in frictional contact with the imaging surface. The blade holding device comprises a frame having a cleaning blade mounted therein and a member coupled to the frame to resiliently apply a tension force on the cleaning blade.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 8:
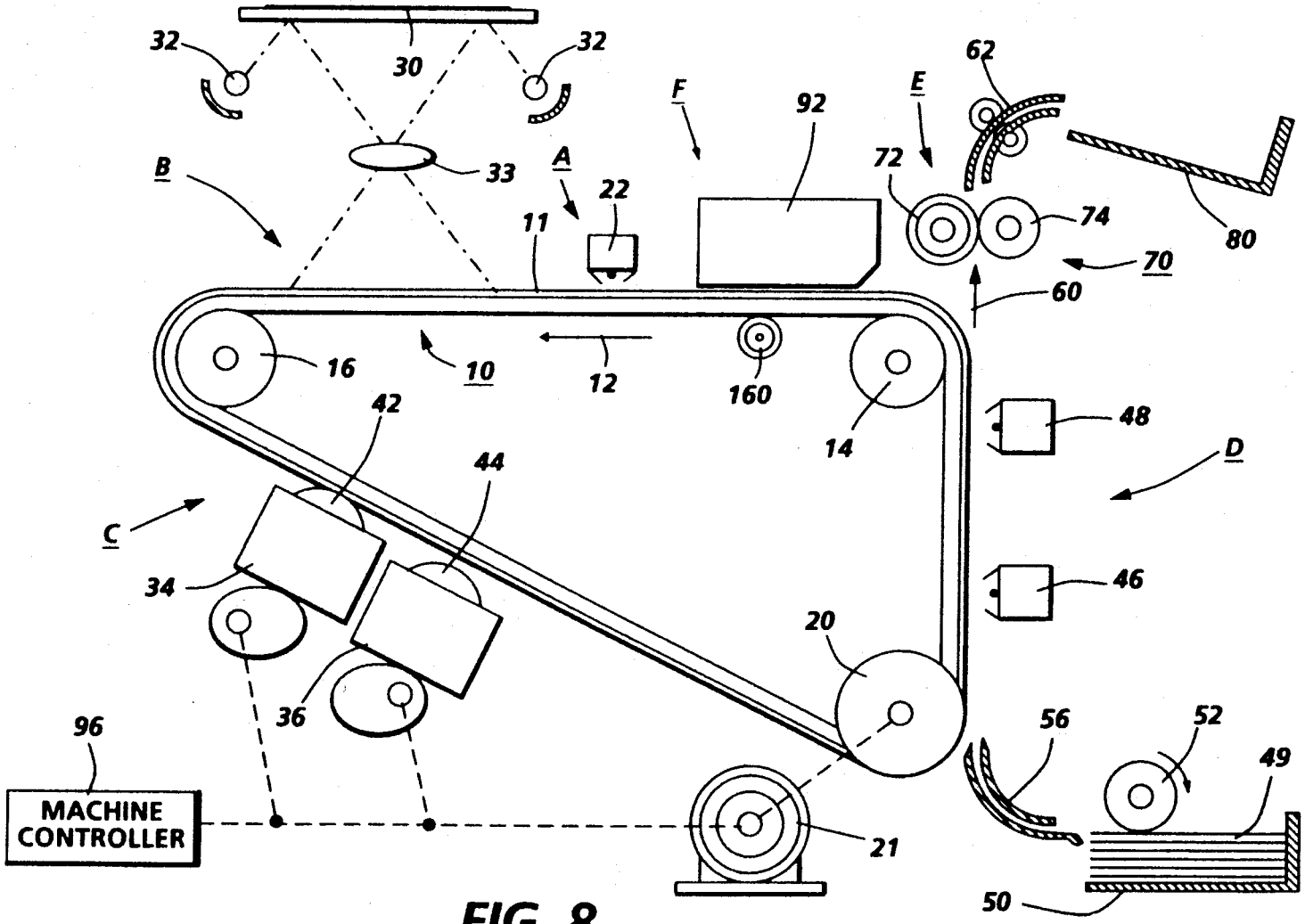
FIG. 8 is a schematic illustration of a printing apparatus incorporating the inventive features of the present invention.

For a general understanding of an electrophotographic printer or copier in which the present invention may be incorporated, reference is made to FIG. 8 which depicts schematically the various components thereof. Hereinafter, like reference numerals will be employed throughout to designate identical elements. Although the electrostatic brush cleaner with a secondary cleaner apparatus of the present invention is particularly well adapted for use in an electrophotographic printing machine, it should become evident from the following discussion, that it is equally well suited for use in other applications and is not necessarily limited to the particular embodiments shown herein.

Referring now to the drawings, the various processing stations employed in the reproduction machine illustrated in FIG. 8 will be described briefly hereinafter. It will no doubt be appreciated that the various processing elements also find advantageous use in electrophotographic printing applications from an electronically stored original, and with appropriate modifications, to an ion projection device which deposits ions in image configuration on a charge retentive surface.

A reproduction machine, in which the present invention finds advantageous use, has a photoreceptor belt 10, having a photoconductive (or imaging) surface 11. The photoreceptor belt 10 moves in the direction of arrow 12 to advance successive portions of the belt 10 sequentially through the various processing stations disposed about the path of movement thereof. The belt 10 is entrained about a stripping roller 14, a tension roller 16, and a drive roller 20. Drive roller 20 is coupled to a motor 21 by suitable means such as a belt drive. The belt 10 is maintained in tension by a pair of springs (not shown) resiliently urging tension roller 16 against the belt 10 with the desired spring force. Both stripping roller 14 and tension roller 16 are rotatably mounted. These rollers are idlers which rotate freely as the belt 10 moves in the direction of arrow 12.

With continued reference to FIG. 8, initially a portion of the belt 10 passes through charging station A. At charging station A, a corona device 22 charges a portion of the photoreceptor belt 10 to a relatively high, substantially uniform potential, either positive or negative.

At exposure station B, an original document is positioned face down on a transparent platen 30 for illumination with flash lamps 32. Light rays reflected from the original document are reflected through a lens 33 and projected onto the charged portion of the photoreceptor belt 10 to selectively dissipate the charge thereon. This records an electrostatic latent image on the belt which corresponds to the informational area contained within the original document. Alternatively, a laser may be provided to image-wise discharge the photoreceptor in accordance with stored electronic information.

Thereafter, the belt 10 advances the electrostatic latent image to development station C. At development station C, one of at least two developer housings 34 and 36 is brought into contact with the belt 10 for the purpose of developing the electrostatic latent image. Housings 34 and 36 may be moved into and out of developing position with corresponding cams 38 and 40, which are selectively driven by motor 21. Each developer housing 34 and 36 supports a developing system such as magnetic brush rolls 42 and 44, which provides a rotating magnetic member to advance developer mix (i.e. carrier beads and toner) into contact with the electrostatic latent image. The electrostatic latent image attracts toner particles from the carrier beads, thereby forming toner powder images on the photoreceptor belt 10. If two colors of developer material are not required, the second developer housing may be omitted.

The photoreceptor belt 10 then advances the developed latent image to transfer station D. At transfer station D, a sheet of support material such as paper copy sheets is advanced into contact with the developed latent images on the belt 10. A corona generating device 46 charges the copy sheet to the proper potential so that it becomes tacked to the photoreceptor belt 10 and the toner powder image is attracted from the photoreceptor belt 10 to the sheet. After transfer, a corona generator 48 charges the copy sheet to an opposite polarity to detack the copy sheet from the belt 10, whereupon the sheet is stripped from the belt 10 at stripping roller 14.

Sheets of support material 49 are advanced to transfer station D from a supply tray 50. Sheets are fed from tray 50 with sheet feeder 52, and advanced to transfer station D along conveyor 56.

After transfer, the sheet continues to move in the direction of arrow 60 to fusing station E. Fusing station E includes a fuser assembly, indicated generally by the reference numeral 70, which permanently affixes the transferred toner powder images to the sheets. Preferably, the fuser assembly 70 includes a heated fuser roller 72 adapted to be pressure engaged with a backup roller 74 with the toner powder images contacting the fuser roller 72. In this manner, the toner powder image is permanently affixed to the sheet, and such sheets are directed via a shoot 62 to an output 80 or finisher.

Residual particles, remaining on the photoreceptor belt 10 after each copy is made, may be removed at cleaning station F. The cleaning apparatus of the present invention is represented by the reference numeral 92. (See FIGS. 5 and 6 for more detailed views of the present invention.) Removed residual particles may also be stored for disposal.

A machine controller 96 is preferably a known programmable controller or combination of controllers, which conventionally control all the machine steps and functions described above. The controller 96 is responsive to a variety of sensing devices to enhance control of the machine, and also provides connection of diagnostic operations to a user interface (not shown) where required.

As thus described, a reproduction machine in accordance with the present invention may be any of several well known devices. Variations may be expected in specific electrophotographic processing, paper handling and control arrangements without affecting the present invention. However, it is believed that the foregoing description is sufficient for purposes of the present application to illustrate the general operation of an electrophotographic printing machine which exemplifies one type of apparatus employing the present invention therein. Reference is now made to FIGS. 1 through 7 where the showings are for the purpose of illustrating a preferred embodiment of the invention and not for limiting the same.

Figure 1A:
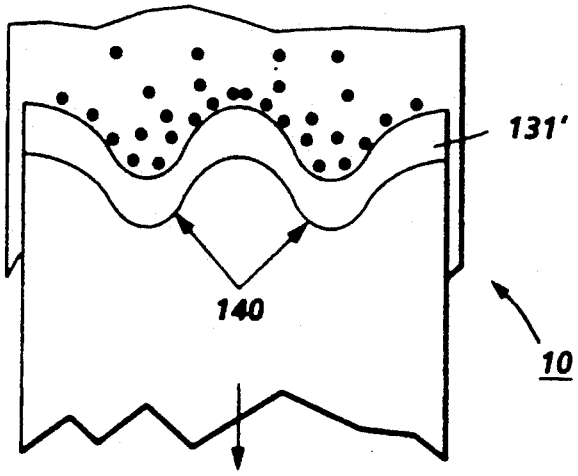
FIG. 1A shows a schematic elevational view of the blade edge during contact with the smooth imaging surface.
Figure 1B:
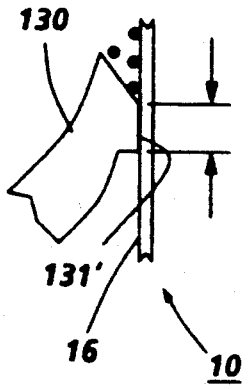
FIG. 1B is a side elevation view showing the wide contact width of the cleaning blade edge.
Figure 2A:
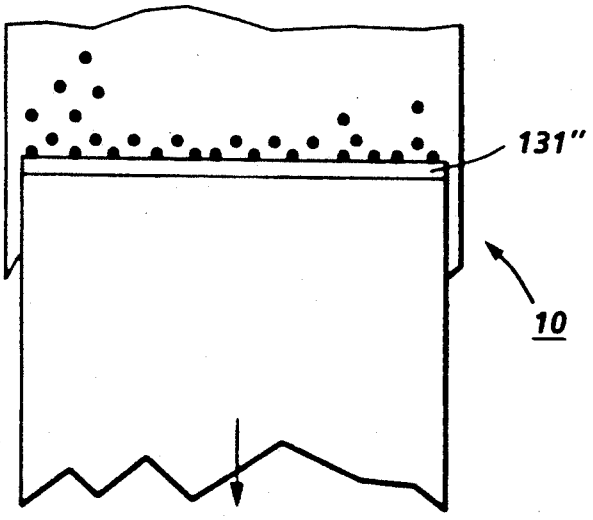
FIG. 2A shows a schematic elevational view of the cleaning blade edge during contact with the roughened imaging surface.
Figure 2B:
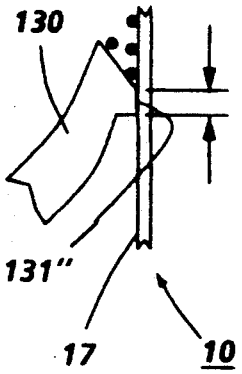
FIG. 2B is a side elevational view showing a reduced contact width of the cleaning blade edge.

Referring now to FIGS. 1 and 2, which compare features of an elastomer blade edge in sliding contact with a smooth imaging surface 16 (FIG.1B) and with a textured (or roughened) imaging surface 17 (FIG. 2B). Note that FIGS. 2A and 2B are only intended to demonstrate the essential attributes of blade contact with an appropriately roughened photoreceptor surface. FIGS. 2A and 2B therefore do not show or include the actual surface asperities which induce the displayed blade edge behavior. In FIG. 1A, it is shown how the blade edge 131' lacks contact uniformity with the imaging surface. FIG. 1A shows how the random edge tucks 140 cause nonuniformity at the blade edge. The blade edge tucks 140 move laterally during actual copy or traverse of the imaging member, appearing and disappearing as contact regions are encountered with different coefficients of friction. Furthermore, as indicated by FIG. 1B, the blade cleaning edge 131' is elongated due to the high surface friction. This elongation causes the cleaning blade edge 131' to have a wider contact width to the edge as depicted in FIG. 1B. In FIG. 2A, asperities (not shown) have been added to the imaging surface to cause roughening of the imaging surface 17 (see FIG. 1B) and thus, the frictional contact between the blade edge and the photoreceptor surface is reduced. As a result, the lower frictional force causes a reduction in the contact width of the cleaning blade edge 131'' with the photoreceptor 10. This reduction in contact width of the cleaning blade edge 131'' is shown in FIG. 2B. The comparison of FIGS. 1A, 1B, 2A and 2B clarify the present invention. The present invention identifies and describes a modified elastomer cleaning blade holder specifically designed to reduce excessive tuck in the blade edge arising from local enhancements in blade/-photoreceptor friction. This invention improves cleaning blade performance by promoting contact uniformity between the blade edge and the photoreceptor as shown in FIG. 2A without having to roughen or otherwise alter the delicate imaging surface of the photoreceptor.

Figure 3:
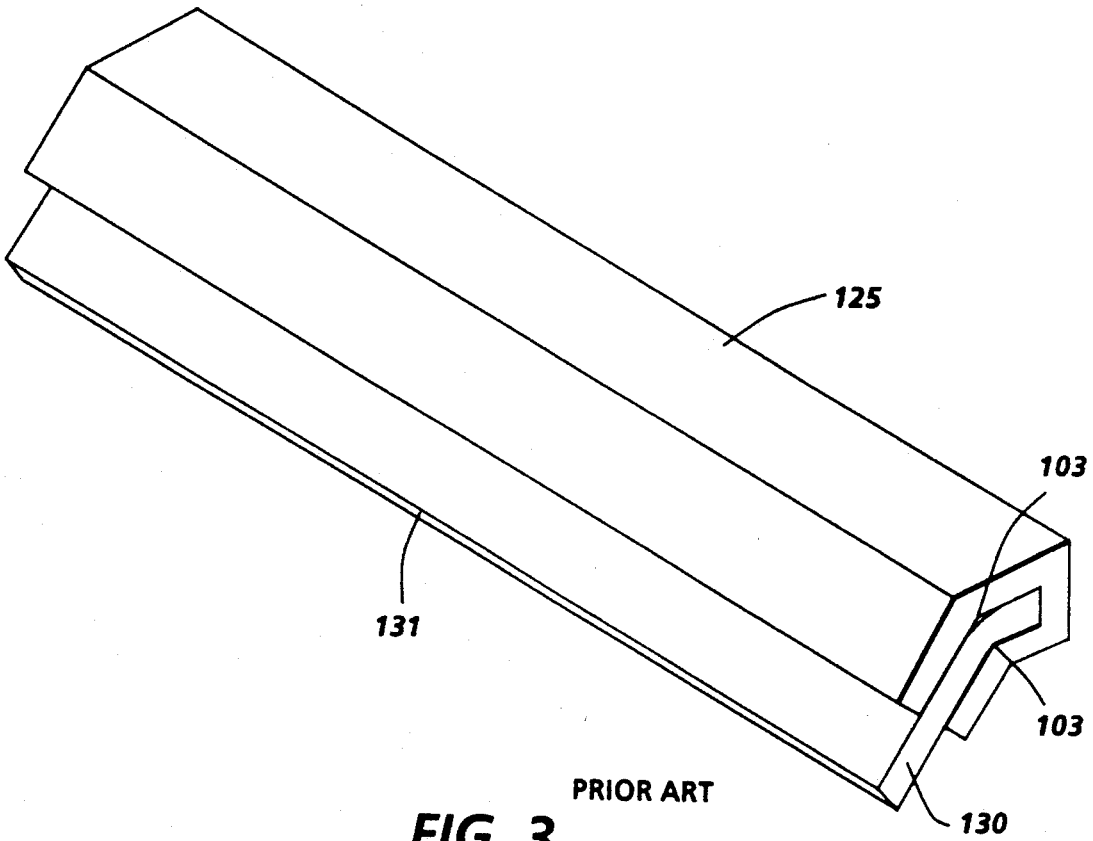
PRIOR ART FIG. 3
FIG. 3 is a schematic, perspective view of a standard blade holder and elastomer cleaning blade.

Referring to FIG. 3 which shows an example of how a typical elastomer cleaning blade 130 is mounted in a standard blade holder 125. Caution is taken when installing the blade 130 into its holder 125 to keep from creating stresses/strains which might cause discontinuities in the blade edge 131 properties or alignment. The entire elastomer blade 130 is first gently wedged into the holder 125 so that the blade ends align with the outside edges of the holder 125. At this point, the blade is not fully seated because a substantial insertion force is required to slip the blade 130 over the bevel 103 in the holder 125 so that it rests against the back end of the holder 125. The center of the blade 130 is then wedged into the holder 125 a little further toward the back edge of the holder 125 followed by further wedging in both ends of the blade 130. Finally, the rest of the blade 130 is brought into compliance so that the edge is straight. This procedure is repeated until the blade 130 is fully seated and the extending cleaning blade edge 131 is straight.

Figure 4:
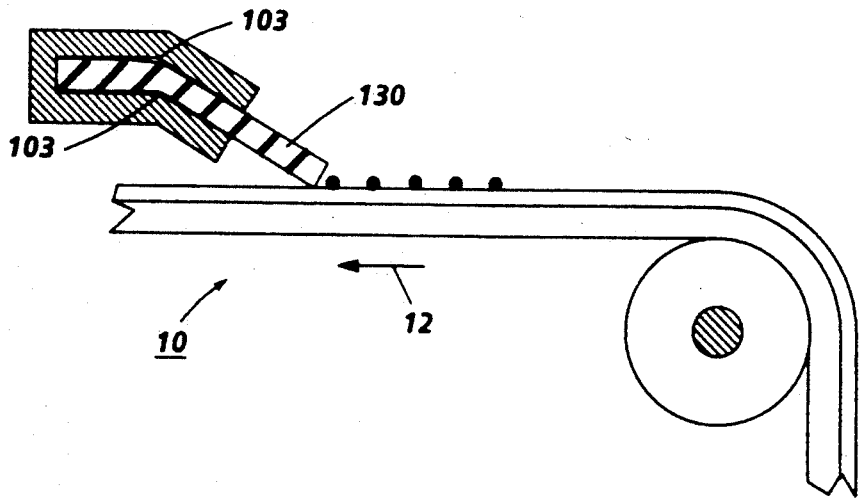
FIG. 4 shows a schematic elevational view, partially in section of the cleaner assembly in a 12 o'clock position.

Referring to FIG. 4 which shows a schematic of the present invention in a 12 o'clock position. The photoreceptor 10 moves in the direction indicated by arrow 12. A fair indication of how the blade 130 (shown here in a doctoring mode) rests in the holder is shown in FIG. 4. The blade 130 in the fully seated position does not exactly conform to the holder groove, but in actuality "bends" around the bevel 103.

Figure 5:
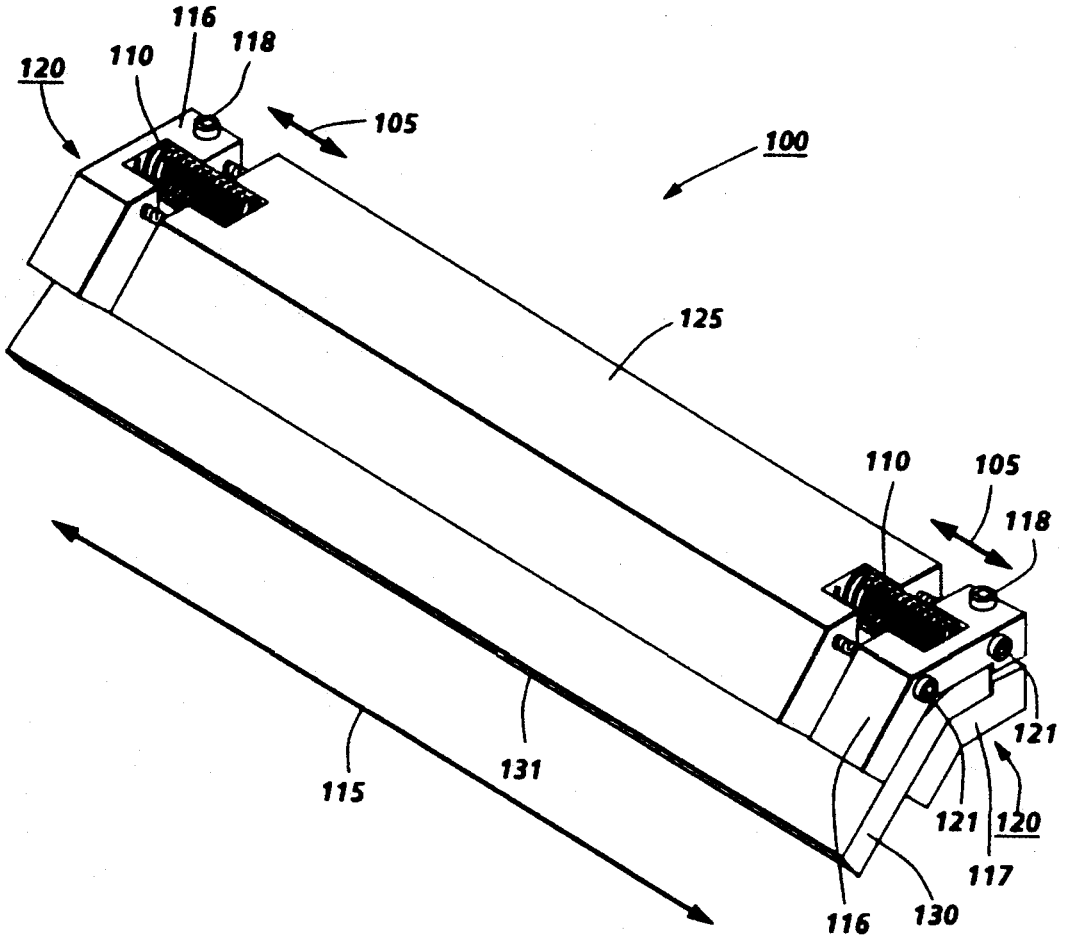
FIG. 5 is a schematic, perspective view of the preferred embodiment of the present invention showing end clamps applying a tension force to stretch the blade.

Referring to FIG. 5 which shows a schematic of the proposed modified cleaning blade holder 100 and notes the essential mechanism by which it works. As shown in FIG. 5, the invention is an end clamp 120 or clamping mechanism which can be fixed to each end of a standard cleaning blade holder. The end clamps 120 grip and hold the ends of the cleaning blade 130 stationary to allow the blade to be drawn or stretched lengthwise (115 shows direction of stretching motion) once fully seated in the assembled mechanism—the standard holder and clamps. The degree or amount of lengthwise draw or stretch 115 can be regulated by, for example, a screw device 121 (see FIG. 6) which couples the clamping pieces to the main body, but which moves away from, or separates from the main blade applied or relieved periodically by coupling the clamping ends 120 to the blade holder body 125 through an oscillating device. Adjustable spacers 110 are used to back the end clamps 120 away from the body 125 of the holder. The idea is to stretch the blade laterally 115 to induce and optimize lateral elastomer stress/strain so that this internal force will "pull" the blade edge 131 back into compliance when tucking is initiated.

The invention, as shown in FIG. 5, has several advantages over the standard blade holder which includes: the potential to eliminate the need to develop special toner/developer packages to address "new" blade problems and/or failures (i.e. including special additives to inhibit cometing such as Unilin TM ); increases reliability of cleaning the photoreceptor surface without adversely affecting the simple and economical approach of blade cleaning; improving blade cleaning reliability due to the uniform contact and the elimination of tucking in the present invention; and increasing the elastomer blade edge rebound response time to photoreceptor asperities. (It is noted here that this is not the bulk material response time which can be directly measured with standard techniques, but that of a tucked or curled, highly strained/stressed cleaning blade edge).

Figure 6:
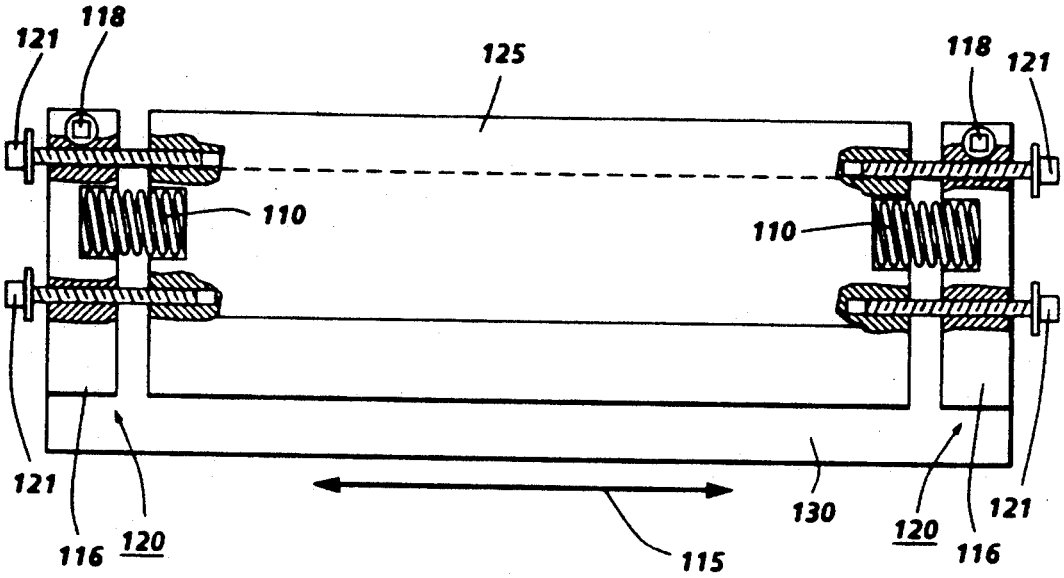
FIG. 6 shows an elevational view, partially in section, of one method of attaching the clamping ends to the holder of the FIG. 5 embodiment.

Referring now to FIG. 6, which shows one method of attaching the clamping ends 120 to the main holder body 125 and stretching the blade laterally 115 across the width of the photoreceptor surface. The clamping ends 120 are spring loaded against the holder body 125 such that when the set screws 121 are withdrawn the coupled device expands to stretch the blade 130 laterally. The adjustable spacers 110 connect the holder body 125 to the clamping ends 120, allowing the lateral stretching action of the blade 130 to occur.

Figure 7:
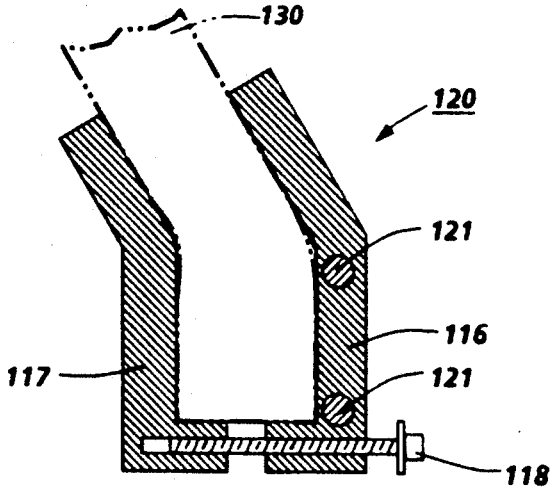
FIG. 7 shows a schematic elevational view, partially in section showing one method of attaching the top and bottom clamping ends to each other.

Referring to FIG. 7, which more clearly shows one way of joining the clamping ends 120 together as illustrated in FIG. 6. The top clamping end 116 is connected to the bottom clamping end 117 by a screw 118 to allow the clamping ends 120 to compress and hold the cleaner blade securely in place.

In recapitulation, the apparatus for stretching a cleaning blade uniformly over the imaging surface in the present invention requires two end clamps connected to a main blade body. An adjustable spacer, connecting each end clamp to the main blade body, enables the stretching action of the blade holder. The blade holder also reduces excessive tuck in the blade edge arising from local enhancements in blade/photoreceptor friction. Contact uniformity between the blade edge and the photoreceptor improves the cleaning blade performance. The blade holder of the present invention obviates the need to add asperities to the surface of the imaging member so that a cleaning blade does not fail by allowing toner to escape cleaning action by passing under the blade at positions of excessive edge tuck. Furthermore, in the present invention the tension caused by the blade holder provides sufficient tension to place and maintain the cleaning blade into uniform frictional contact with the imaging surface without undue friction resulting.

It is, therefore, apparent that there has been provided in accordance with the present invention, a blade holder with end clamps that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for removing residual particles from an imaging surface, comprising:

a cleaning blade having an edge adapted to remove the residual particles from the imaging surface;

a frame having said cleaning blade mounted therein; and means, coupled to said frame, for resiliently applying a tension force on said cleaning blade, in a direction substantially parallel to the edge thereof, to provide substantially uniform contact between the edge of said blade and the imaging surface, said frame including an end clamp having one end of said blade fixed therein; and a holder having the central position of said blade mounted therein, said resilient means being interposed between said end clamp and one end of said blade holder to apply the tension force on said clamp.

2. An apparatus as recited in claim 1, wherein said frame further comprises:

a second end clamp having the other end of said blade fixed therein, said resilient means being interposed between said second end clamp at the other end of said blade holder to apply said tension force on said second end clamp.

3. An apparatus as recited in claim 2, wherein said resilient means comprises:

a first spring interposed between said first mentioned end clamp and one end of said blade holder; and a second spring interposed between said second end clamp at the other end of said blade holder.

4. An apparatus as recited in claim 1, further comprising means for adjustably attaching said end clamp to said holder.

5. A blade holding device for placing a cleaning edge of a cleaning blade in frictional contact with an imaging surface to remove residual particles from the imaging surface, comprising:

a frame having the cleaning blade mounted therein; and a member, coupled to said frame, to resiliently apply a tension force on the cleaning blade, said frame including an end clamp having an end of the cleaning blade fixed therein; and a holder having the central position of the cleaning blade mounted therein, said coupling member being interposed between said end clamp and said holder to apply the tension force on said end clamp.

6. An apparatus as recited in claim 5, wherein said frame further comprises:

a second end clamp, having the other end of said blade fixed therein, said coupling member being interposed between said second end clamp and the other end of said blade holder to apply said tension force on said second end clamp.

7. A device as recited in claim 6, wherein said coupling member comprises:

a first spring interposed between said first mentioned end clamp and one end of said blade holder; and a second spring interposed between said second end clamp and the other end of said blade holder.

8. A device as recited in claim 5, wherein said coupling member adjustably attaches said end clamp to said holder.

* * * * *